US008479783B2

(12) United States Patent
Dellaquila

(10) Patent No.: US 8,479,783 B2
(45) Date of Patent: Jul. 9, 2013

(54) BALLOON TYING APPARATUS AND METHOD

(76) Inventor: Peter James Dellaquila, Fort Lauderdale, FL (US)

( * ) Notice: Subject to any disclaimer, the term of this patent is extended or adjusted under 35 U.S.C. 154(b) by 340 days.

(21) Appl. No.: 13/031,811

(22) Filed: Feb. 22, 2011

(65) Prior Publication Data

US 2011/0253255 A1 Oct. 20, 2011

Related U.S. Application Data

(60) Provisional application No. 61/325,284, filed on Apr. 17, 2010.

(51) Int. Cl.
*B65B 3/16* (2006.01)

(52) U.S. Cl.
USPC ..... 141/114; 141/314; 289/17; 289/18.1

(58) Field of Classification Search
USPC ..... 141/313, 314, 317, 98, 114; 289/17, 289/18.1; 53/284.7, 79; 446/220, 222
See application file for complete search history.

(56) References Cited

U.S. PATENT DOCUMENTS 4,989,906 A * 2/1991 Peverley ..... 289/17
8,307,612 B1 * 11/2012 Sikorcin ..... 53/284.7
2011/0030844 A1 * 2/2011 Wang ..... 141/314

* cited by examiner

*Primary Examiner* — Jason K Niesz
(74) *Attorney, Agent, or Firm* — David W. Barman

(57) ABSTRACT

A balloon tying article is provided with a first wall, a second wall and a cavity therebetween whereby a balloon is tied using each of the walls to knot the balloon neck.

6 Claims, 6 Drawing Sheets

BALLOON TYING APPARATUS AND METHOD

INDEX TO RELATED APPLICATIONS

This application claims benefit from U.S. Provisional Patent No. 61/325,284, filed Apr. 17, 2010, the disclosure of which is incorporated herein by reference in its entirety.

BACKGROUND OF THE INVENTION

The tying of inflated balloons is sometimes met with great difficulty. Many people are unable to form a knot in the inflating neck of an inflated balloon. Additionally, persons inflating and tying many balloons find it more difficult as more balloons are tied. A need exists for an effective balloon tying article.

BRIEF SUMMARY OF THE INVENTION

The present invention provides an article incorporated with a balloon inflating nozzle that facilitated tying inflated balloons.

The present invention is an article for tying a balloon comprising:

a first wall;

a second wall;

each of said first and second wall positioned above a balloon inflating nozzle; and a cavity defined by each of said first wall, second wall and nozzle.

In one embodiment, the article is constructed as a single contiguous structure with said nozzle having balloon tying apparatus incorporated thereon.

The article is also formed in an arrangement having the balloon tying apparatus separate from said nozzle and attached to said nozzle. A preferred attachment is a snap fit arrangement.

The balloon tying article has a first wall and second wall extend above the outlet nozzle. The outlet nozzle has a proximal end attached to a balloon filling structure and a shaft extending distally from the balloon filling structure and having a tapered end with a gas outlet.

The first wall and said second wall of the tying apparatus are configured such that said cavity is substantially u-shaped.

The cavity has an opening on top of each of said first and second walls and an opening facing the nozzle.

The invention also includes a balloon inflating assembly having a body comprising:

a gas inlet;

an internal hollow pathway for the movement of gas from said inlet into said body;

a nozzle, wherein said nozzle has a nozzle inlet for gas moving through said body, said nozzle having a tapered gas outlet;

a structure attached to said body, wherein said structure has a first wall, a second wall, each of said first wall and said second wall define a cavity;

said cavity constructed and arranged to be substantially u-shaped.

The assembly walls, in one embodiment, are integrated with said body.

In another embodiment, the assembly walls are removeably attached to said main body.

From the description of the present invention as set forth herein, a number of advantages of the subject balloon pump with device built into handle to aid in the tying of balloons become evident:

(a) with the use of a combination balloon pump and balloon tying tool, a person actively blowing up balloons does not have to choose between maintaining two separate tools, one for pumping air into the balloon and a separate one to assist in the tying of the balloon, or doing without a tool to assist in the tying of the balloon;

(b) the designed tying tool will make the utilizing of balloons more convenient and efficient;

(c) with the use of a combination balloon pump and balloon tying tool, the user need not maintain keep track of and locate two different tools;

(d) with the use of a combination balloon pump and tying tool, the user does not have to put the balloon pump down in order to tie a balloon.

This makes the process of preparing blown up balloons significantly more efficient and faster.

Accordingly, the present invention provides that the balloon pump with device built into handle to aid in the tying of balloons can be used to blow up balloons easily and conveniently, allows for more efficient storage and retrieval when ready to use, assists in the process of blowing up balloons by providing a tool to assist in the tying of a balloon once it has been blown up, and makes the process of blowing up a balloon easier and faster by allowing the user to tie a not in the balloon without having to put the balloon pump down first.

DETAILED DESCRIPTION OF THE PREFERRED EMBODIMENT

Figure 1:
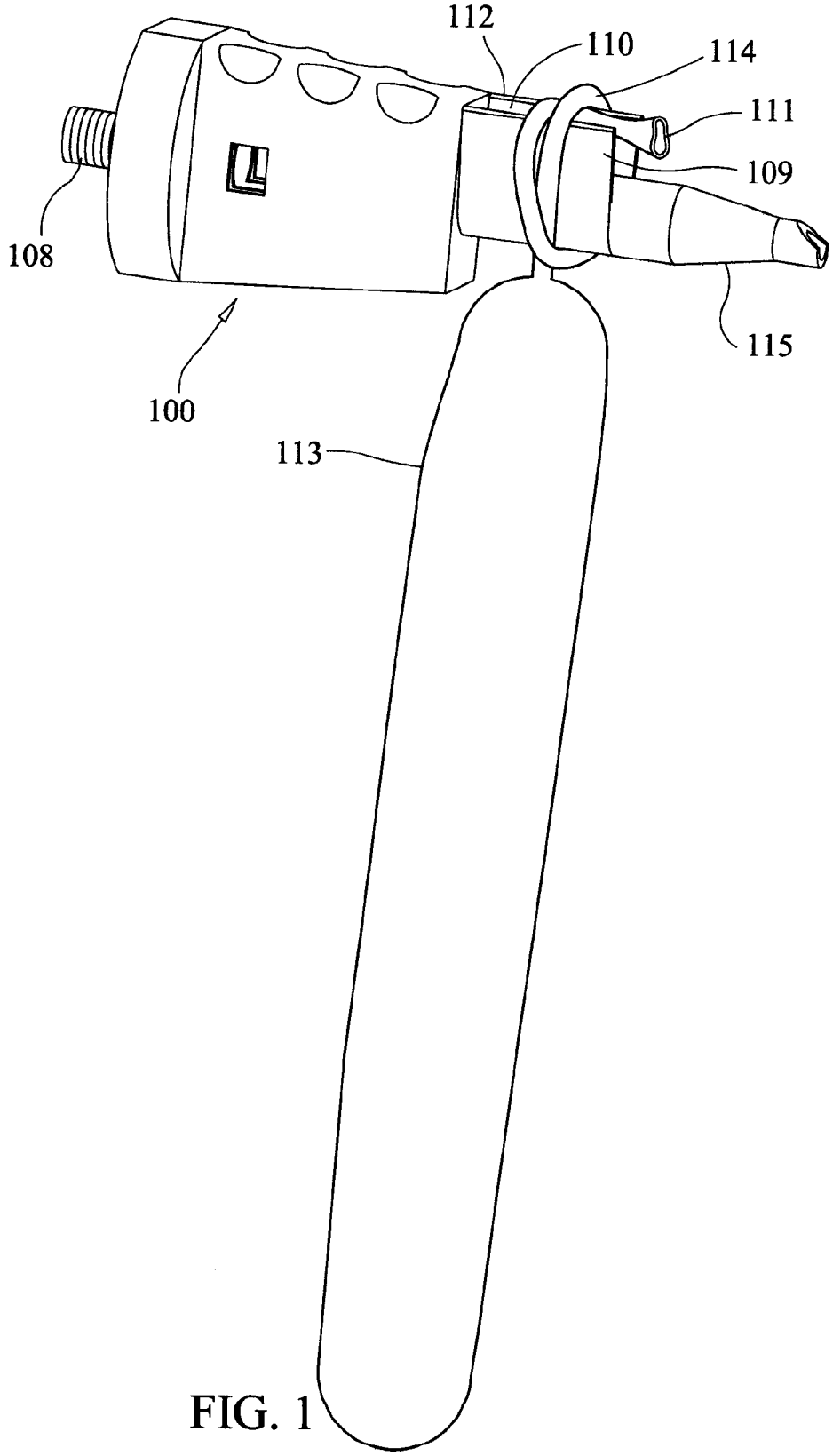
FIG. 1 is a side perspective view of the balloon tying apparatus of the present invention.
Figure 2:
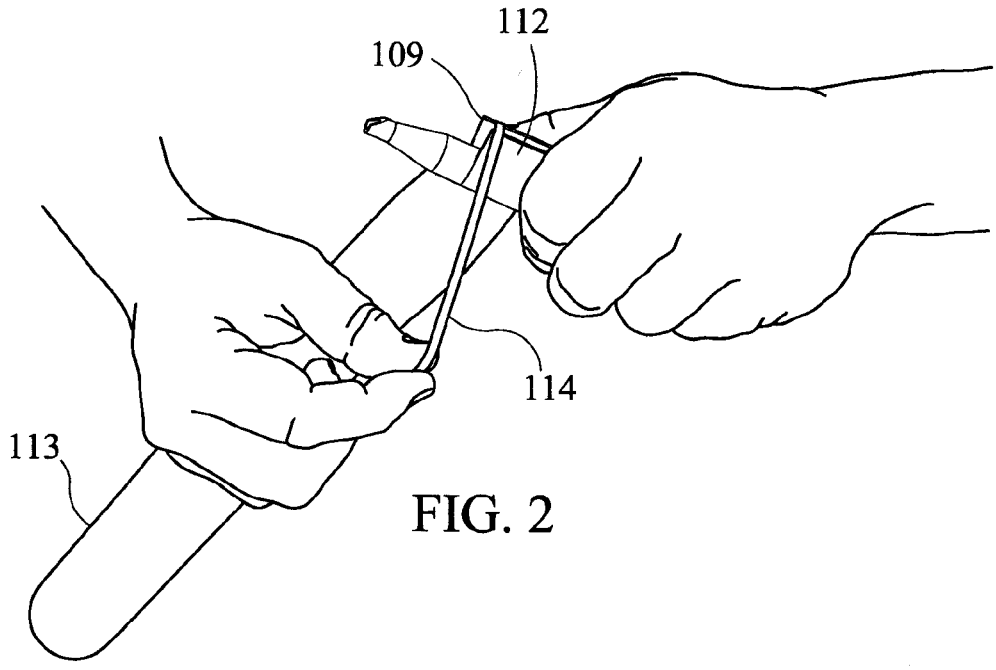
FIG. 2 shows the first step in tying a balloon using the apparatus of the present invention.
Figure 3:
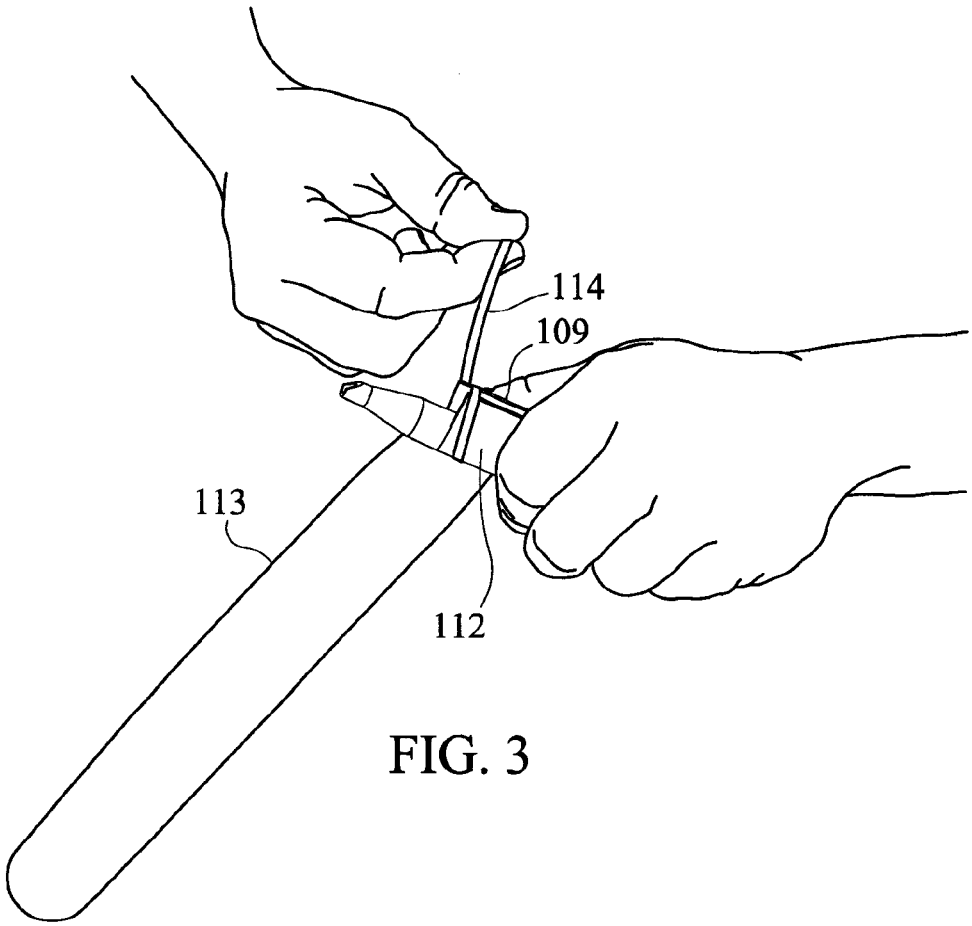
FIG. 3 shows the second step in tying a balloon using the apparatus of the present invention.
Figure 4:
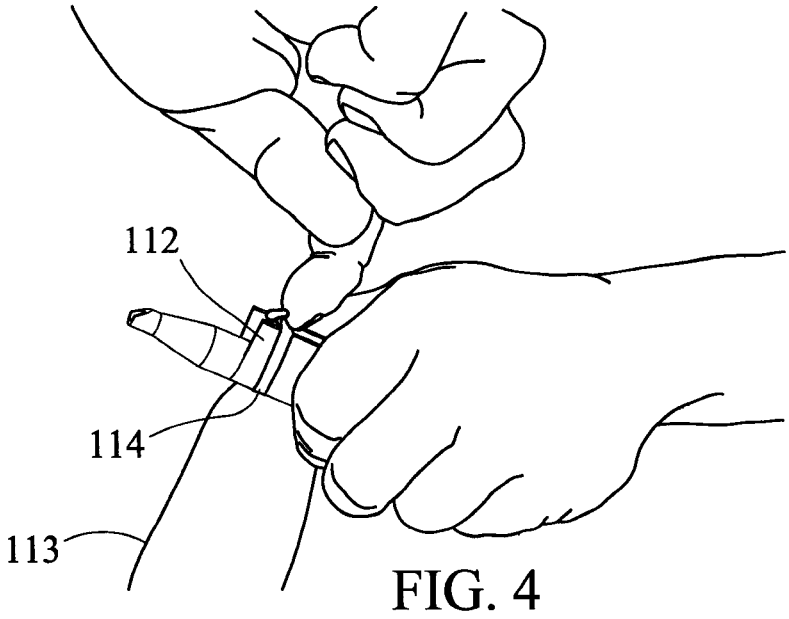
FIG. 4 shows the third step in tying a balloon using the apparatus of the present invention.
Figure 5:
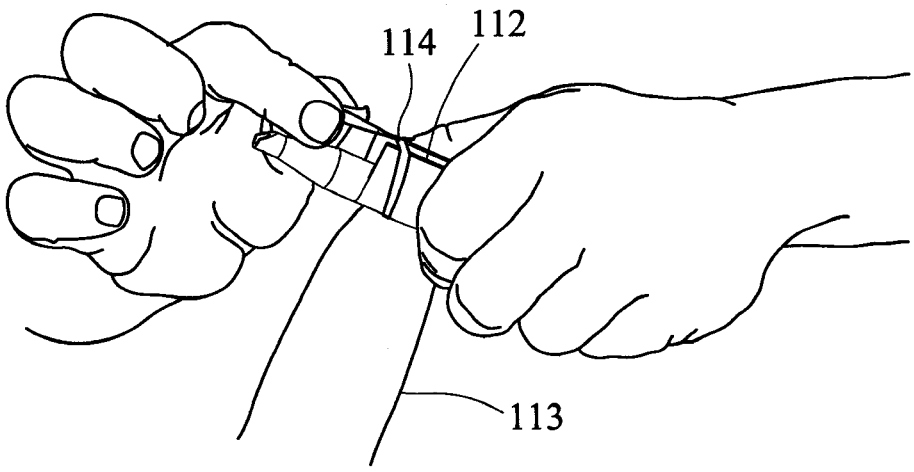
FIG. 5 shows the fourth step in tying a balloon using the apparatus of the present invention.

Gas dispenser 100 has an inlet 108 and an outlet 115. Gas dispenser 100 is any dispenser suitable for providing gas to fill a balloon. The gas supplied is any acceptable balloon filing gas which may include, but would not be limited to, ambient air, helium, combinations thereof, and the like. Gas dispenser 100 may be attached to a manual hand operated inflating device, a compressed gas tank, a mechanical pump, or the like. Inlet 108 is connected either by hose, or direct connection to a gas source (not shown). Gas passes through the interior of dispenser 100, wherein the interior is constructed and arranged to receive gas through inlet 108 and direct the gas through outlet 115. Incorporated with dispenser 100 is a structure constructed and arranged to facilitate the tying of an inflated balloon. The structure is formed of a first wall 109 and a second wall 112 positioned above outlet 115 such that the upper surface of outlet 115 and each of first wall 109 and a second wall 112 define cavity 110.

Figure 6:
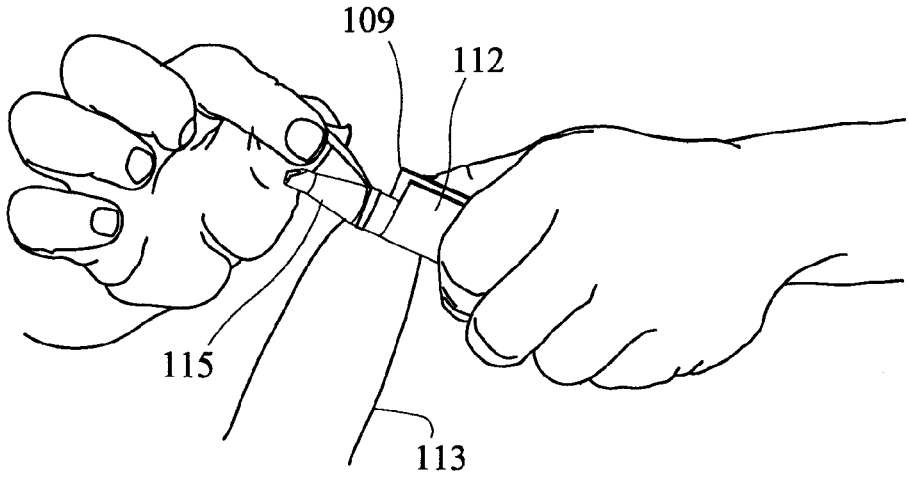
FIG. 6 shows the fifth step in tying a balloon using the apparatus of the present invention.
Figure 7:
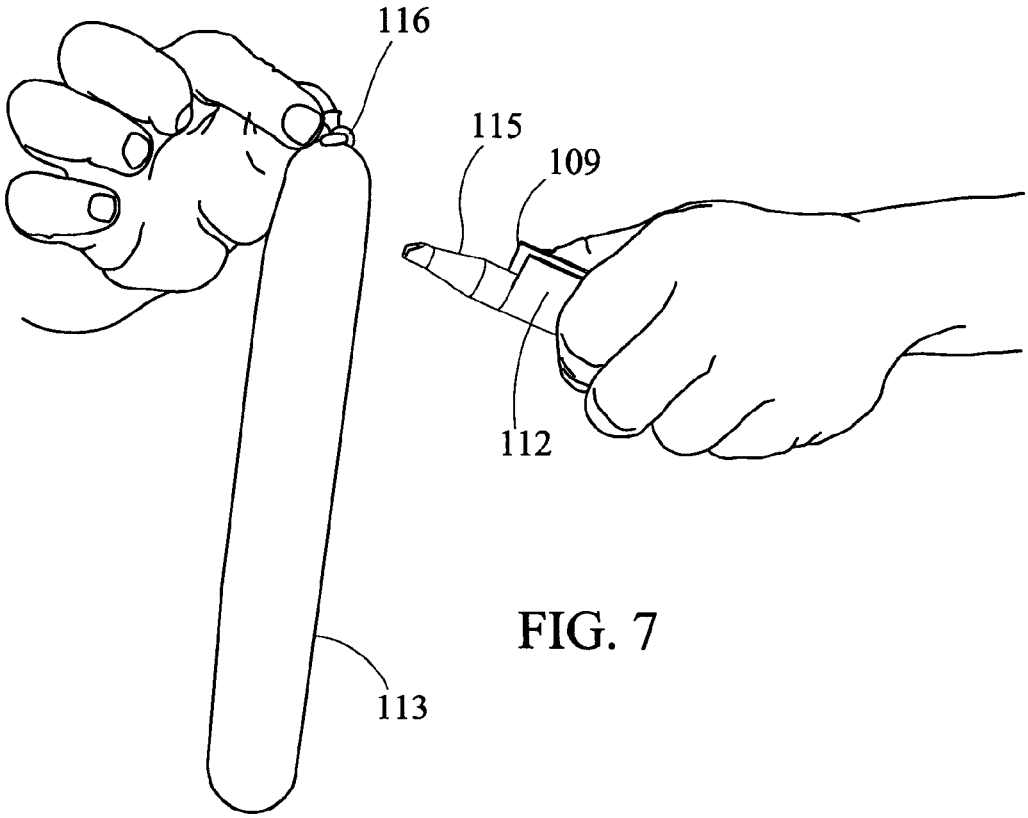
FIG. 7 shows the sixth step in tying a balloon using the apparatus of the present invention.
Figure 8:
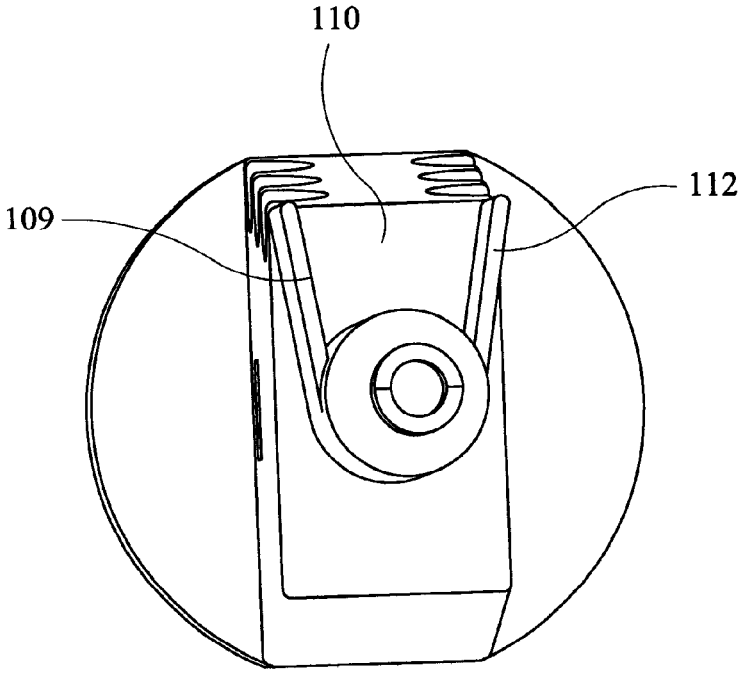
FIG. 8 is a front view of the apparatus of the present invention.

In use, a balloon having balloon main body 113, inflating neck 114 and inlet 111 is inflated. Inflating neck 114 is wrapped around the tying structure around each of first wall 109, second wall 112, and outlet 111 in a manner shown in each of FIGS. 1-5. As shown sequentially in FIGS. 2-5, inflating neck 114 is passed about the outer perimeter of the tying structure. Balloon inlet 115 is subsequently passed under the stretched inflating neck 114 through cavity 110. Balloon inlet 111 is subsequently moved in the general direction of outlet 115. The movement of balloon inlet 111 out from cavity 110 towards outlet 115 urges inflating neck 114 off of each of first wall 109 and second wall 112 and, as shown in FIGS. 6 and 7, forms a knot that prevents gas from escaping through balloon inlet 111.

In a preferred embodiment, dispenser 100 is formed of a single unitary piece incorporating all of the structure thereon.

Figure 9:
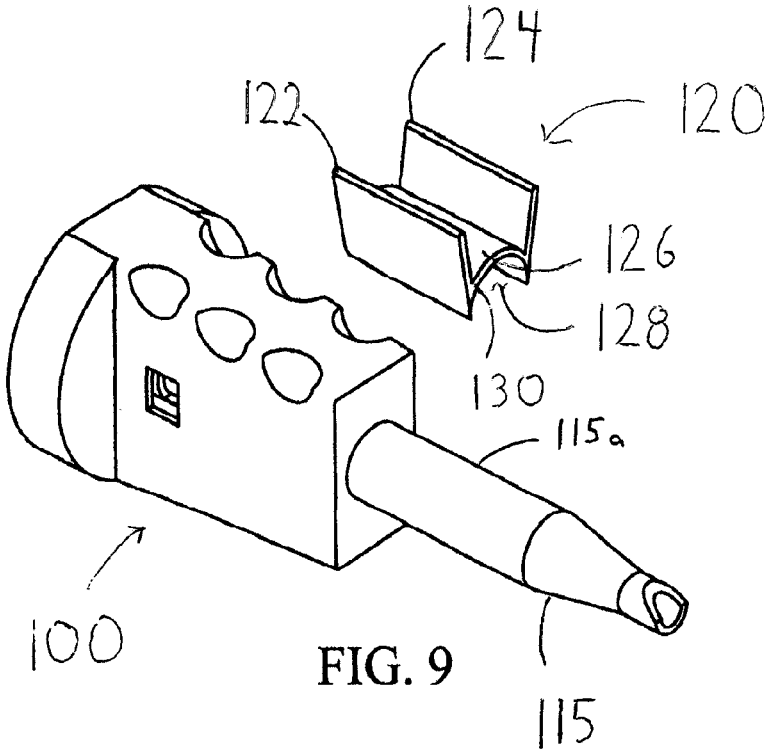
FIG. 9 is an embodiment whereby a convex attachment is a structure for tying a balloon that attaches in a snap fit arrangement.

In one embodiment, as shown in FIG. 9, tying attachment 120 has a first wall 122 and a second wall 124 with a convex floor 126 therebetween. The arrangement of tying attachment 120 forms a curved under portion 130 that defines a curved cavity 128 constructed and arranged to attach to the proximal shaft 115*a* of outlet 115 in a snap fit type arrangement.

Figure 10:
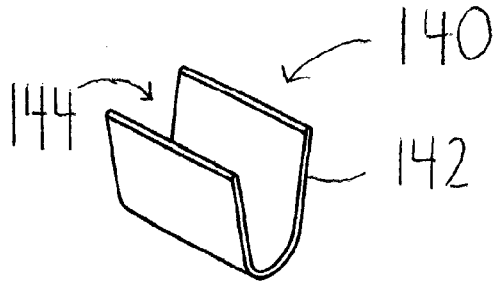
FIG. 10 is an embodiment whereby a concave attachment is a structure for tying a balloon that attaches in a snap fit arrangement.

Another embodiment, as shown in FIG. 10, provides a tying attachment 140 formed a as continual curved wall 142 that defines a cavity 144 which is constructed and arranged to attach to the proximal shaft 115*a* of outlet 115 in a snap fit type arrangement.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An article for tying a balloon comprising: a first wall; a second wall; each of said first and second wall positioned above a balloon inflating nozzle; and a cavity defined by each of said first wall, second wall and nozzle.

2. The article of claim 1 wherein said article is constructed as a single contiguous structure with said nozzle.

3. The article of claim 1 wherein said article is formed separate from said nozzle and attached to said nozzle.

4. The article of claim 1 wherein said first wall and second wall extend above said nozzle.

5. The article of claim 1 wherein said first wall and said second wall are configured such that said cavity is substantially u-shaped.

6. The article of claim 1 wherein said cavity has an opening on top of each of said first and second walls and an opening facing said nozzle.

* * * * *